US006862865B1

(12) United States Patent
Auerbach et al.

(10) Patent No.: US 6,862,865 B1
(45) Date of Patent: Mar. 8, 2005

(54) METHOD AND APPARATUS FOR ADJUSTING THE POSITION OF AN ENVELOPE STOPPER IN AN ENVELOPE INSERTION MACHINE

(75) Inventors: David Auerbach, West Redding, CT (US); Carlos de Figueiredo, Sandy Hook, CT (US); John W. Sussmeier, Cold Spring, NY (US)

(73) Assignee: Pitney Bowes Inc., Stamford, CT (US)

( * ) Notice: Subject to any disclaimer, the term of this patent is extended or adjusted under 35 U.S.C. 154(b) by 271 days.

(21) Appl. No.: 09/696,132

(22) Filed: Oct. 26, 2000

(51) Int. Cl.[7] ..... B65B 5/04
(52) U.S. Cl. ..... 53/67; 53/64; 53/76; 53/284.3
(58) Field of Search ..... 53/64, 67, 76, 53/284.3

(56) References Cited

U.S. PATENT DOCUMENTS 4,020,615 A * 5/1977 Irvine et al. ..... 271/2
4,337,609 A * 7/1982 Foster et al. ..... 53/284.3
5,168,689 A * 12/1992 Macelis ..... 53/284.3
5,191,751 A * 3/1993 Marzullo et al. ..... 53/381.7
5,247,780 A * 9/1993 Kulpa et al. ..... 53/381.5
5,251,425 A * 10/1993 Kern ..... 53/381.7
5,255,498 A * 10/1993 Hotchkiss et al. ..... 53/258
5,447,015 A * 9/1995 Belec et al. ..... 271/271
5,630,312 A * 5/1997 Ballard et al. ..... 53/284.3
5,660,030 A * 8/1997 Auerbach et al. ..... 53/284.3
5,675,959 A * 10/1997 Hamma et al. ..... 53/381.1
5,832,702 A * 11/1998 Jacobson et al. ..... 53/284.3
5,848,518 A * 12/1998 Bufalini et al. ..... 53/284.3

* cited by examiner

*Primary Examiner*—John Sipos
*Assistant Examiner*—Michelle Lopez
(74) *Attorney, Agent, or Firm*—Christopher J. Capelli; Angelo N. Chaclas

(57) ABSTRACT

A method and apparatus for adjusting the position of an envelope stopper in an envelope inserting area of a mail insertion machine. By placing an envelope of a desirable size at a desired location in the envelope inserting area and using one or more fingers to sense the edge of the envelope. When the fingers are moved from the upstream end towards the downstream end, they are supported the envelope before they are moved past the edge of the envelope. As the fingers are moved past the edge of the envelope towards the downstream end, they are allowed to drop into a gap thereby changing the position of the fingers. A photosensing device is coupled to the fingers to sense the change of the position of the fingers.

18 Claims, 8 Drawing Sheets

METHOD AND APPARATUS FOR ADJUSTING THE POSITION OF AN ENVELOPE STOPPER IN AN ENVELOPE INSERTION MACHINE

FIELD OF THE INVENTION

The present invention relates generally to an envelope insertion machine and, more particularly, to a mechanism to place an envelope in the envelope inserting area of the envelope insertion machine.

BACKGROUND OF THE INVENTION

In a mail insertion machine, there is an envelope feeder on one end of the machine to sequentially release envelopes into an envelope inserting area. On the other end of the mail insertion machine, there is a gathering section where enclosure material is released and gathered. If the enclosure material contains a number of documents, the documents are separately released from a plurality of enclosure feeders. The released documents are then collated into a stack to be moved into the envelope inserting area where the document stack is inserted into the envelope. Envelopes can be fed from below the envelope inserting area by a lower envelope transport system. Usually, the flap of each envelope is flipped away from the throat of the envelope as the envelope is transported from the envelope feeder toward the envelope inserting area.

Mail insertion machines are well known. For example, U.S. Pat. No. 4,501,417 (Foster et al.) discloses an inserter feeder assembly for feeding enclosures; U.S. Pat. No. 4,753,429 (Irvine et al.) discloses a collating station; and U.S. Pat. No. 5,660,030 (Auerbach et al.) discloses an envelope inserting station wherein envelopes are separately provided to an envelope supporting deck where envelopes are spread open in order to allow enclosure material to be stuffed into the envelopes.

In a typical mail insertion machine, only one envelope is placed in the envelope inserting area at anytime to receive enclosure material. When the envelope is placed in the envelope inserting area and its flap is flipped away from the throat, the throat is spread open by a vacuum-suction device or by a set of mechanical fingers. As the envelope is fed from the envelope feeder from the upstream end of the inserting area, it is stopped by an envelope stopper so that the envelope is consistently placed at a desirable position for mail insertion. Typically, the vacuum-suction device or the mechanical fingers are fixedly located in the inserting area. Thus, the position of the envelope stopper must be adjusted in accordance with the length or size of the envelope.

It is desirable and advantageous to provide a method and an apparatus for adjusting the position of the envelope stopper according the size of the envelope in a simple yet precise manner.

SUMMARY OF THE INVENTION

The first aspect of the present invention is an apparatus for adjusting the position of an envelope stopper in an inserting area of an envelope insertion machine, wherein the inserting area has an upstream end and an downstream end, and the envelope stopper is positioned between the upstream end and the downstream end, for stopping an envelope fed from the upstream end towards the downstream end along a feeding direction, in order to place the envelope at a desired location for mail insertion, and wherein the envelope has a size and an edge, and the position of the envelope stopper is adjusted according to the size of the envelope, so that the edge of the envelope is substantially aligned with the envelope stopper when the envelope is stopped. The apparatus comprises:

a sensing device, coupled to the envelope stopper, adapted to sense the edge of the envelope when the envelope is placed at the desired location; and a mechanism, for moving the sensing device and the envelope stopper along the feeding direction and for placing the envelope stopper when the sensing device senses the edge of the envelope.

Preferably, the envelope stopper has a stop edge which is capable of operating at a first position and a second position, and wherein the envelope stopper is capable of stopping the envelope fed from the upstream end with the stop edge when the stop edge is operated at the first position; and the envelope stopper allows the envelope fed from the upstream to pass by the envelope stopper when the stop edge is operated at the second position, and wherein the stop edge is operated at the second position when the envelope stopper is moved by the moving means along the feeding direction in order to adjust the position of the envelope stopper.

Preferably, the sensing device comprises a photosensing device which is adapted to produce a signal when the sensing device senses the edge of the envelope so as to allow the moving means to place the envelope stopper in response to the signal.

Preferably, the sensing device further comprises at least one mechanical finger pivotally mount on the sensing device, wherein the mechanical finger is positioned at a first level, supported by the envelope, when the envelope stopper is away from the edge of the envelope and further away from the downstream end, and wherein the mechanical finger is positioned at a second level when the envelope stopper is away from the edge of the envelope and further away from the upstream end, and wherein the photosensor device produces the signal when the position of the mechanical finger is changed from the first level to the second level, or from the second level to the first level.

Preferably, the photosensing device comprises a pair of photosensors and the finger is coupled to a blocking mechanism such that the photosensors are blocked by the blocking mechanism at a blocking position when the finger is positioned at the first level, and the blocking mechanism is removed from the blocking position when the finger is positioned at the second level.

Preferably, the photosensors are separately mounted on a mounting device having a gap separating the photosensors, and wherein the blocking mechanism includes a blade capable of moving into the gap to the blocking position to block the photosensors when the finger is positioned at the first level.

Preferably, the envelope is supported by a plurality of endless belts in the inserting area, and the endless belts define a recess therebetween, and wherein the finger is capable of moving into the recess to be positioned at the second level.

The second aspect of the present invention is a method for adjusting the position of an envelope stopper in an inserting area of an envelope insertion machine, wherein the envelope stopper is positioned between the upstream end and the downstream end, according to the size of the envelope, for stopping an envelope fed from the upstream end towards the downstream end along a feeding direction, in order to place the envelope for mail insertion. The method comprises the steps of:

placing the envelope at a desired location;

providing a sensing device capable of sensing the edge of the envelope;

moving the sensing device and the envelope stopper along the feeding direction; and interrupting the movement of the envelope stopper when the sensing device senses the edge of the envelope, wherein the sensing device is coupled to the envelope stopper so that the edge of the envelope is substantially aligned with the envelope stopper when the sensing device senses the edge of the envelope.

Preferably, the sensing device is capable of providing a signal when the sensing device senses the edge of the envelope and the movement of the envelope stopper is interrupted in response to the signal.

Preferably, the sensing device comprises at least one mechanical finger pivotally mount on the sensing device, wherein the mechanical finger is positioned at a first level, supported by the envelope, when the envelope stopper is away from the edge of the envelope and further away from the downstream end, and wherein the mechanical finger is positioned at a second level when the envelope stopper is away from the edge of the envelope and further away from the upstream end, and wherein the signal is produced when the position of the mechanical finger is changed from the second level to the first level, or from the first level to the second level.

Preferably, the sensing devices further comprises a photosensing device, and the mechanical finger is coupled to a blocking mechanism, and wherein the blocking mechanism is capable of blocking the photosensing device at a blocking position when the finger is positioned at the first level, and the block mechanism is removed from the blocking position when the finger is positioned at the second level, and wherein the photosensing device produces the signal when the blocking device is removed from the blocking position, or when the blocking device moves into the blocking position.

The present invention will become apparent upon reading the description taken in conjunction with FIGS. 1 to 7B.

DETAILED DESCRIPTION

Figure 1:
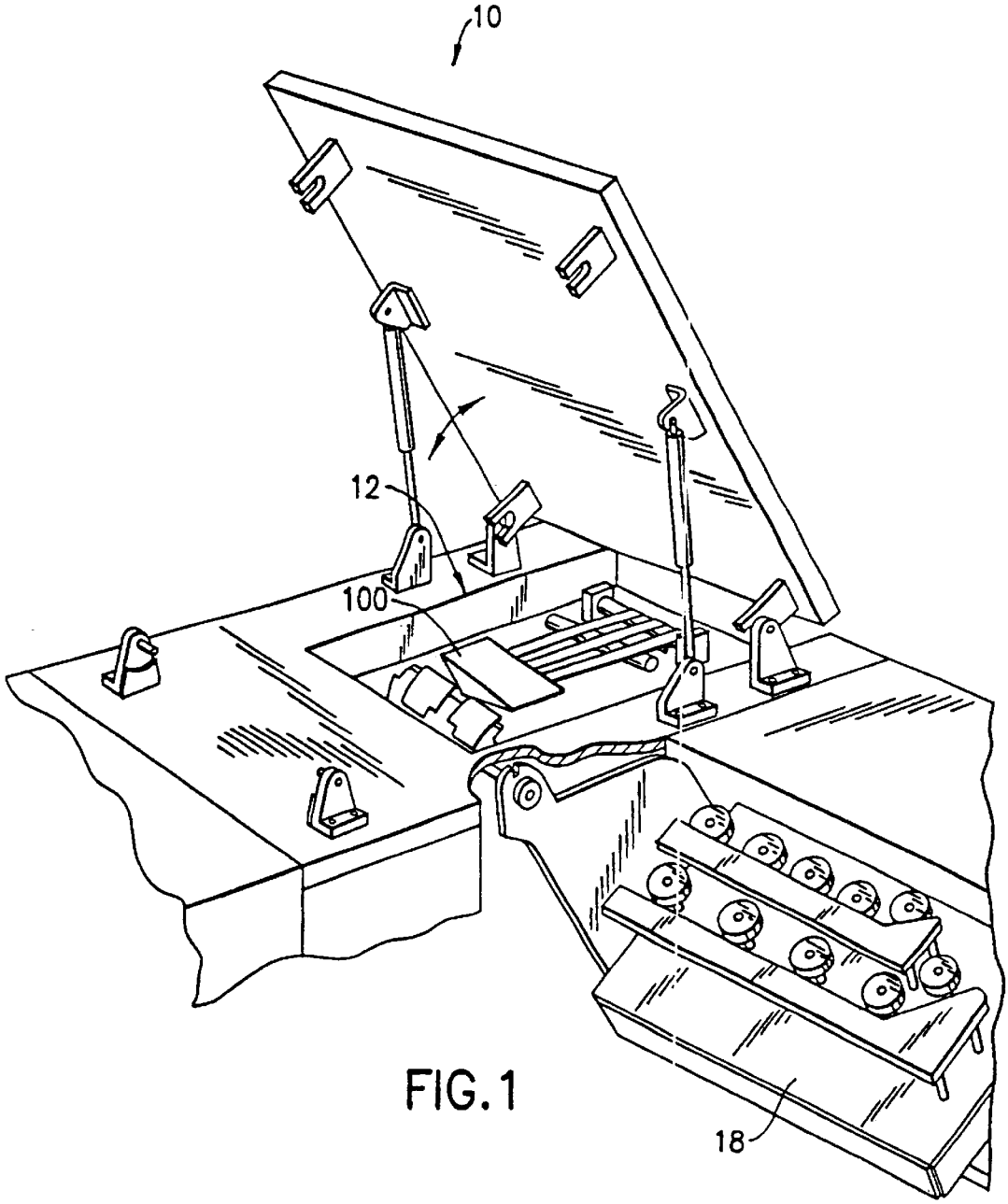
FIG. 1 is a perspective view showing part of a mail insertion machine.

FIG. 1 shows part of a typical mail insertion machine 10. As shown in FIG. 1, the mail insertion machine 10 has a gathering section (not shown) where enclosure material is gathered and collated into a stack to be moved into an envelope inserting area 12. As shown, an envelope 100 is placed in the envelope inserting area 12 to receive enclosure material (see FIG. 2) from the gathering section. The envelope 100 is fed from a feeder, part of which is denoted by numeral 18.

Figure 2:
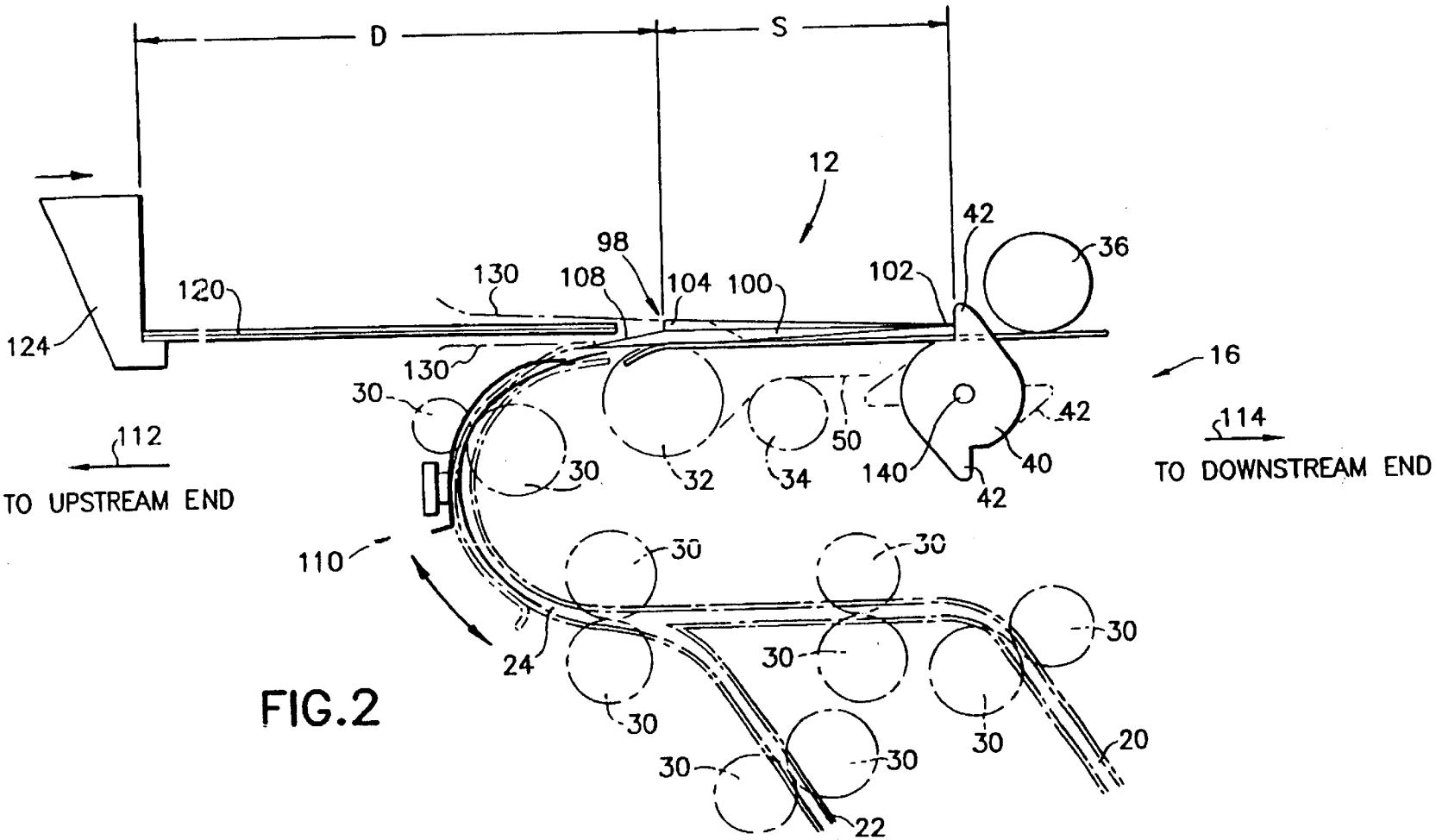
FIG. 2 is a diagrammatic representation illustrating a lower envelope transport connecting an envelope feeder to the envelope inserting area.

FIG. 2 shows part of a lower transport 110 for moving envelopes from the envelope feeder 18 (FIG. 1) towards the envelope inserting area 12. In this particular mail insertion machine, there are two channels 20, 22 for alternately moving one envelope at a time by a plurality of rollers 30 from the envelope feeder 18 through a common channel 24 towards the envelope inserting area 12. The envelope 100 is moved into and located in the envelope inserting area 12 by a belt transport assembly 16, which includes rollers 32, 34 and an endless belt 50. As shown in FIG. 2, the envelope 100 located in the envelope inserting area 12 has a bottom edge 102, and a throat 104 adjoining a flap 108. The flap 108 of the envelope 100 is flipped away from the throat 104. The bottom edge 102 of the envelope 100 is stopped by one of stop edges 42 of an envelope stopper 40, so that the throat 104 of the envelope 100 is positioned at an insertion point 98, where the throat 104 of the envelope 100 is spread open for mail insertion. As shown in FIG. 2, a stack of enclosure material 120 is pushed by a pusher finger 124 from the upstream end 112 through a pair of enclosure material guides 130 into the envelope 100. It is important to set a correct distance D between the insertion point 98 and the pusher finger 124 so that the enclosure material 120 can be properly inserted into the envelope 100. Furthermore, the mail insertion machine 10 can be used with envelopes of different sizes and, therefore, the location of the envelope stopper 40 must be adjusted according the size of the envelope 100. Thus, the distance S between the stop edge 42 of the envelope stopper 40 and the insertion point 98 must be adjusted so that the throat 104 of the envelope 100 is substantially located at the insertion point 98.

The envelope stopper 40 is pivotally mounted at a pivot point 140. The envelope stopper 40 can be operated at a first position to stop an envelope coming from the upstream end 112, and a second position to allow an envelope to move to the downstream end 114. In FIG. 2, the first position of the envelope stopper 40 is shown in solid lines and the second position is shown in dashed lines. After the enclosure material 120 is inserted into the envelope 100, the stuffed envelope (not shown) is moved towards to downstream end 114 by the belt transport assembly 16 and an exit roller 36. At the same time, the envelope stopper 40 is rotated 90 degrees about the pivot point 140 to the second position (see FIGS. 3A and 3B) so that the stop edge 42 is moved out of the way of the stuffed envelope.

Figure 3A:
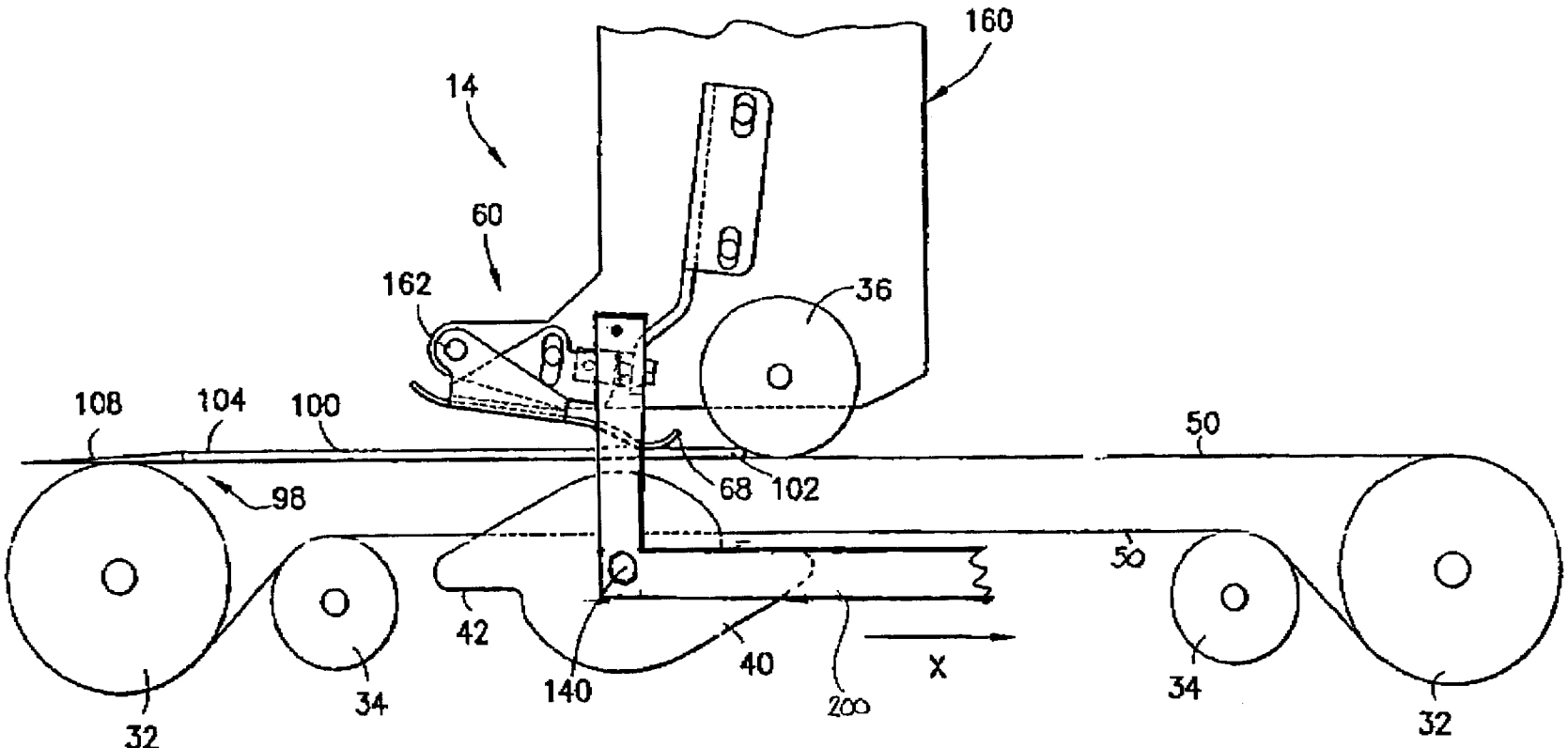
FIG. 3A is a diagrammatic representation illustrating an envelope stopper assembly at one position.
Figure 3B:
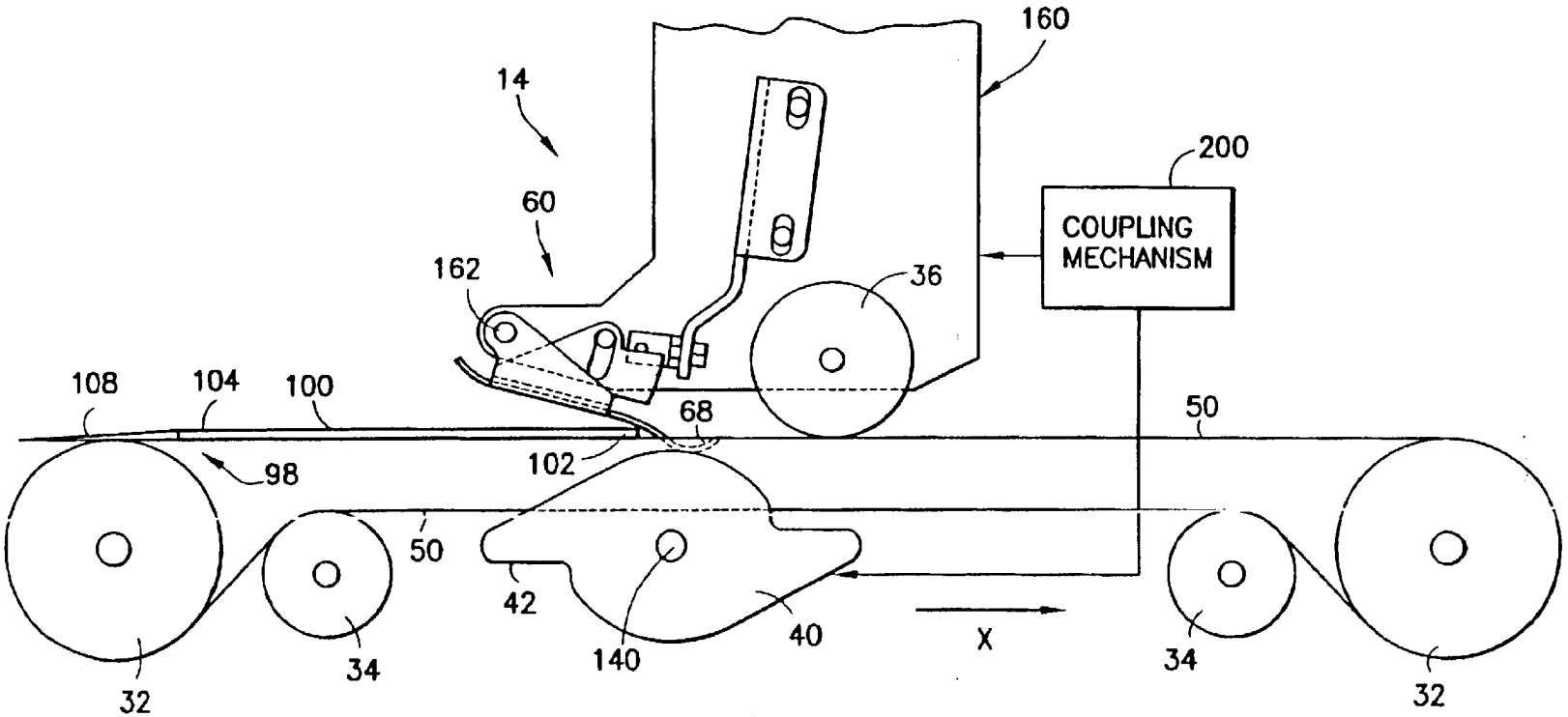
FIG. 3B is a diagrammatic representation illustrating the envelope stopper assembly at another position.

When a stack of envelopes with a different size is used for mail insertion, the location of envelope stopper 40 must be adjusted accordingly. FIGS. 3A and 3B illustrates an envelope stopper assembly 14 for relocating the envelope stopper 40. The envelope stopper assembly 14 includes an envelope sensing assembly 160 which is coupled to the envelope stopper 40 by a coupling mechanism 200 so that the relative position of the envelope stopper 40 and the envelope sensing assembly is fixed. The coupling mechanism 200 can be a mechanical linkage or an electrical linkage using one or more servo motors to position the envelope stopper 40. The envelope stopper assembly 14 can be moved along an X direction to simultaneously relocate the envelope sensing assembly 160 and the envelope stopper 40, along with the exit roller 36. During the relocation of the envelope stopper 40, the envelope stopper 40 is operated at the second position, so that the stop edge 42 does not interfere with the envelope 100 which is placed at a desirable position where the throat 104 is substantially located at the insertion point 98. The envelope sensing assembly 160 includes an edge sensing device 60. As shown in FIGS. 3A and 3B, the edge sensing device 60 has a plurality of fingers 68 (see FIGS. 5B and 5C) which can sense the presence of an envelope placed on the belt 50. The fingers 68 are pivotally mount at pivot 162 so that their position, relative to the surface 150 (see FIGS. 4A and 4B) of the belt 50, can change. As shown in FIG. 3A, the fingers 68 are supported by the envelope 100 and, therefore, the position of the fingers are above the surface of the belt 50. As shown in FIG. 3B, the position of the fingers are dropped below the surface of the belt 50 when the fingers are not supported by the envelope 100. Thus, by moving the envelope stopper assembly 14 along the X direction, it is possible to sense the bottom edge 102 of the envelope 100 by monitoring the position of the fingers 68, relative to the surface of the belt 50. Accordingly, the bottom edge 102 can be sensed by the transition of the position of the fingers 68, as shown in FIG. 3A, to the position of the fingers 68, as shown in FIG. 3B. The relative position of the envelope stopper. 40 to the fingers 68 is set so that when the fingers 68 senses the transition from being supported by the bottom edge 102 to being not supported by the bottom edge 102, the bottom edge 102 is substantially aligned with the stop edge 42 if the envelope stopper 40 is operated at the first position (see FIG. 2).

Figure 4A:
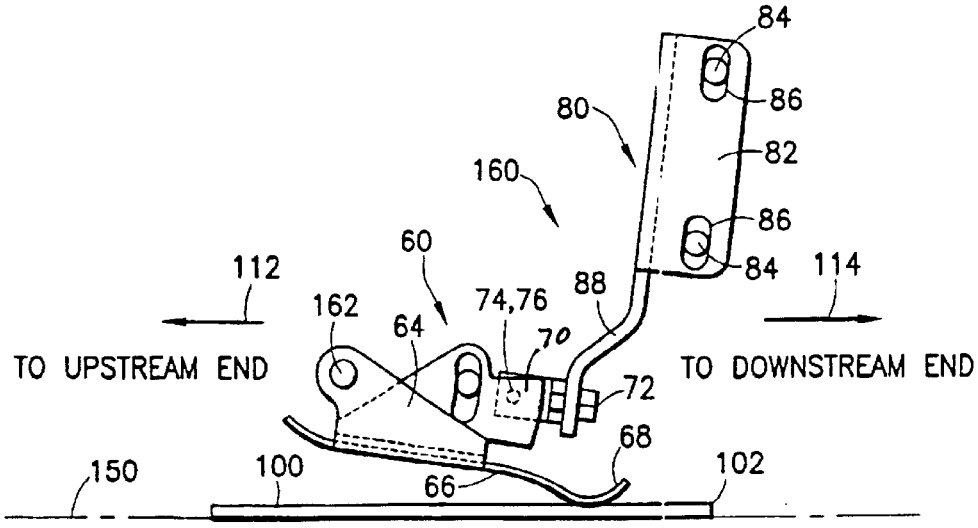
FIG. 4A is a diagrammatic representation illustrating the envelope sensing assembly of the present invention being positioned away from the bottom edge of an envelope, and further away from the downstream end.
Figure 4B:
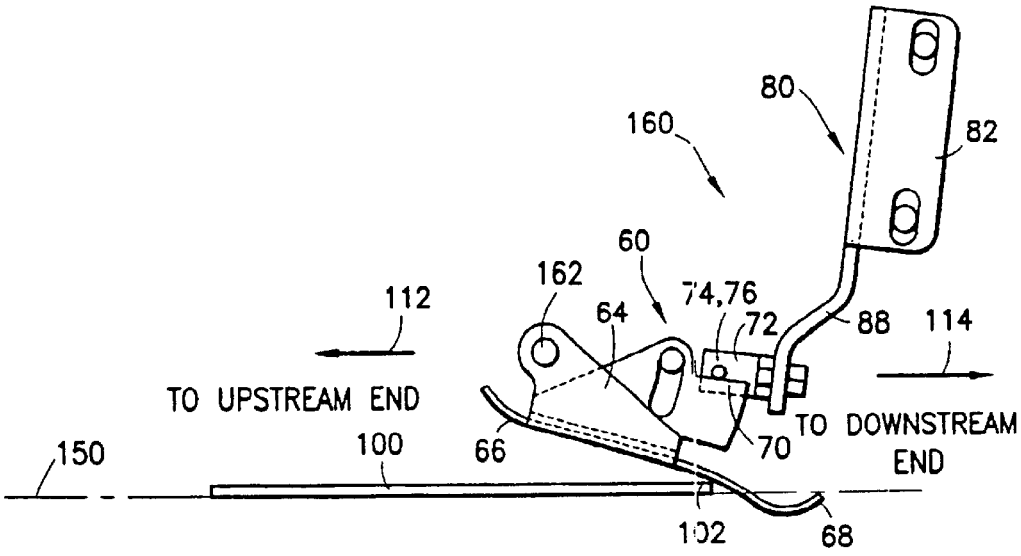
FIG. 4B is a diagrammatic representation illustrating the envelope sensing assembly being positioned at the bottom edge of the envelope.

FIGS. 4A and 4B illustrate the edge sensing device 60 being coupled to a photosensor assembly 80. Each of the fingers 68 is attached to a sensor lever 66 which is connected to an sensor arm 64 to be pivotally mounted at pivot 162. The sensor lever 66 is linked to a blade 70. The photosensor assembly 80 includes a pair of photosensors 74, 76 mounted on a photosensor mount 72. As shown in FIG. 4A, when the fingers 68 are supported by the envelope 100, they are positioned above the surface 150, and the blade 70 is in a Ablocking≅position (see FIG. 7A) for blocking the photosensors 74, 76. As shown in FIG. 4B, when the fingers 68 are not supported by the envelope 100, they are position below the surface 150, and the blade 70 is in a Anon-blocking≅position (see FIG. 7B), allowing the photosensors 74, 76 to function. Thus, the photosensors 74, 76 can be used to produce a signal when the fingers 68 just pass the bottom edge 102 of the envelope 100 while the envelope sensing assembly is moved from the upstream end 112 towards the downstream end 114. As shown in FIGS. 4A and 4B, the photosensor mount 72 is attached to a mounting arm 88 connected to a mounting plate 82. The mounting plate 82 has two slots 86 fitted to two stop pins 84 so as to allow the adjustment of the relative position of the photosensors 74, 76 to the blade 70 for fine-tuning the stopping position by the stop edge 42.

Figure 5A:
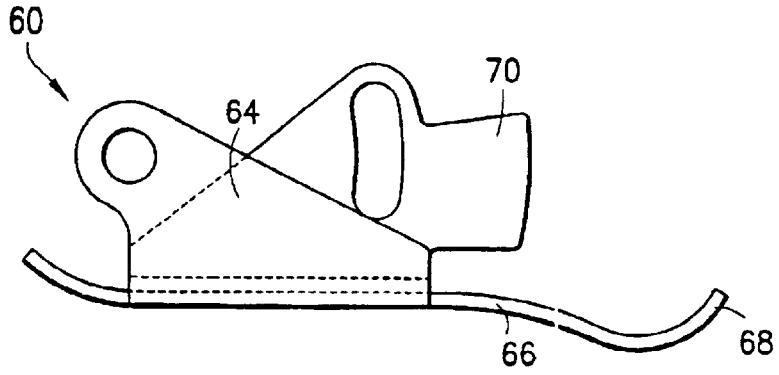
FIG. 5A is a side view of the envelope edge sensing device, according to the present invention.
Figure 5B:
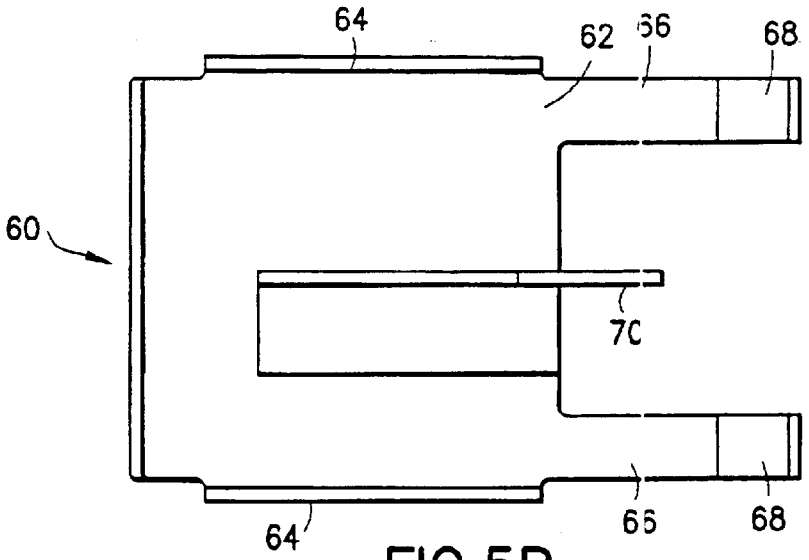
FIG. 5B is a top view of the envelope edge sensing device.
Figure 5C:
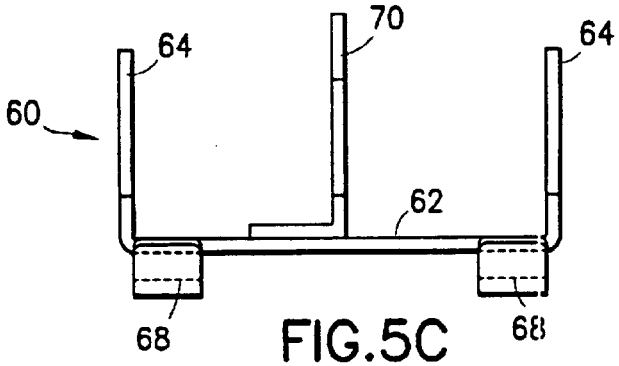
FIG. 5C is a front view of the envelope edge sensing device.

FIGS. 5A–5C illustrates the different views of the edge sensing device 60. As shown, the edge sensing device 60 has two fingers 68, each is part of a sensor lever 66, connected by a connecting plate 62. The blade 70 is rigidly mounted on the connecting plate 62, so that the blade 70 is moved about the pivot point 162 (see FIGS. 4A and 4B) together with the fingers 68.

Figure 6:
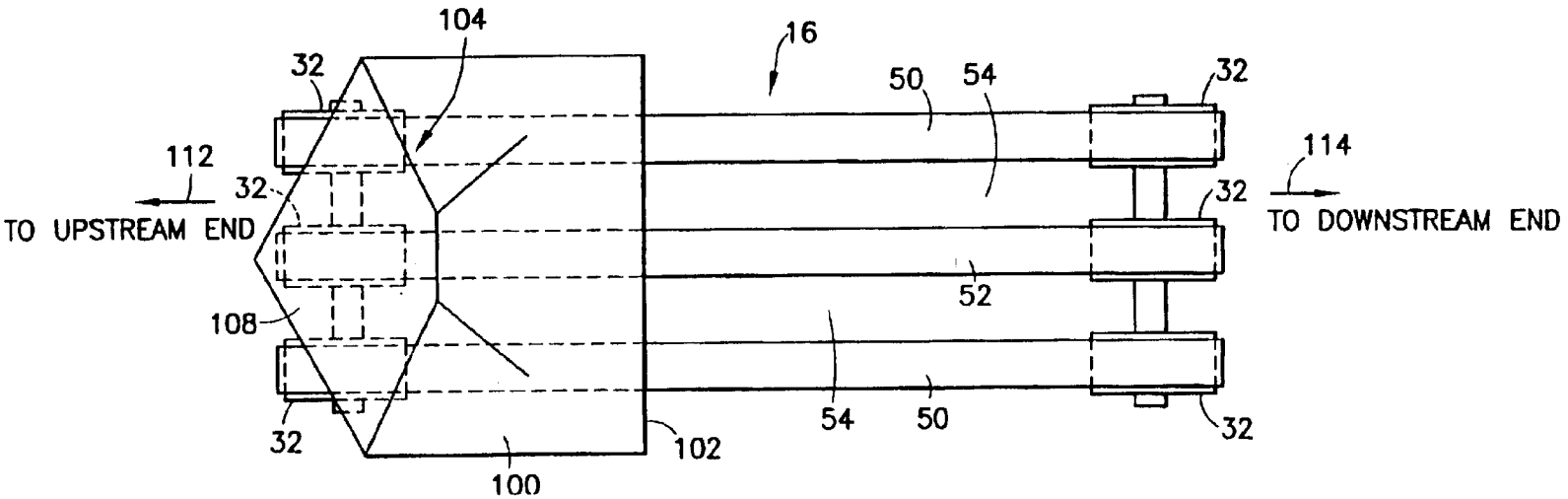
FIG. 6 is a diagrammatic representation illustrating a belt transport assembly, which supports the envelope in the envelope inserting area.

FIG. 6 illustrates the belt transport assembly 16, which includes three belts 50 driven by six rollers 32. As shown, there is a gap 54 between two adjacent belts 50 so as to allow the fingers 68 to drop into the gap 54 when the fingers 68 are not supported by the envelope 100, as shown in FIG. 7B.

Figure 7A:
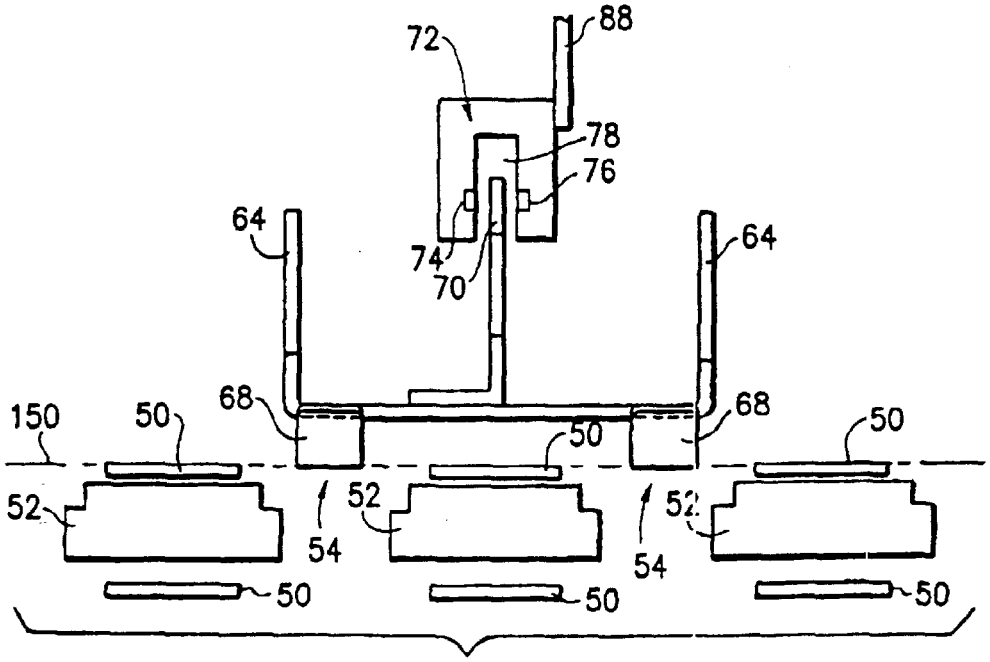
FIG. 7A is a diagrammatic representation illustrating the position of a sensor lever when the envelope sensing assembly is positioned away from the bottom edge of the envelope.
Figure 7B:
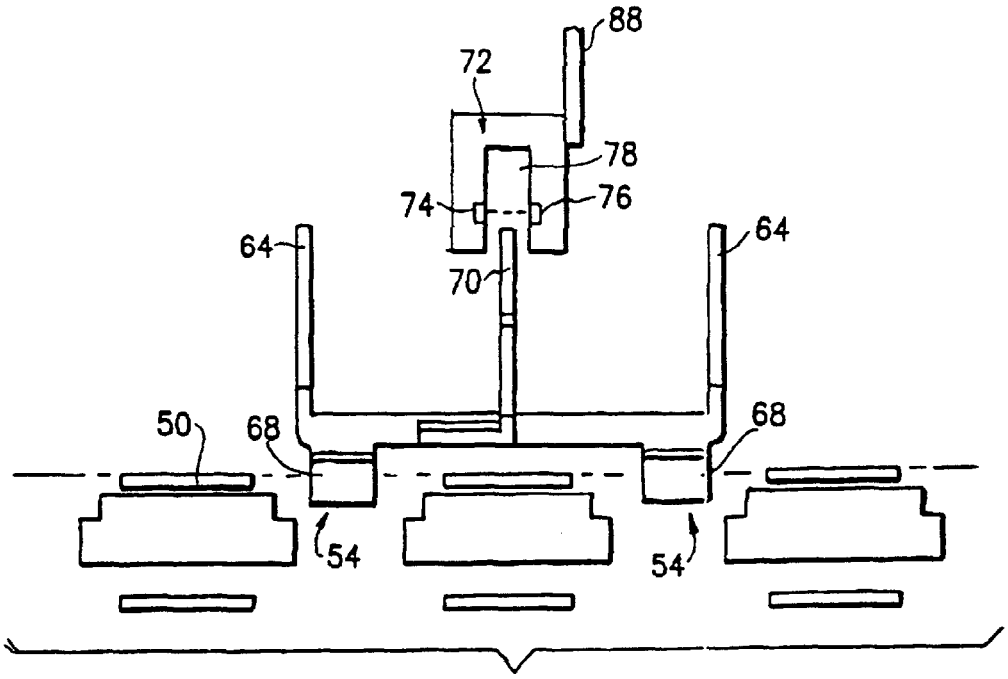
FIG. 7B is a diagrammatic representation illustrating the position of the sensor lever when the envelope sensing assembly is positioned at the bottom edge of the envelope.

As shown in FIGS. 7A and 7B, each of the belts 50 is supported by a belt guide 52. The upper loop of each belt 50 is located on the surface 150. The photosensors 74, 76 are separately mounted on the photosensor mount 72, separated by a gap 78. When the fingers 68 are supported by the envelope 100 (see FIG. 4A) and positioned above the surface 150, the blade 70 is positioned deep inside the gap 78, thereby blocking the photosensor pairs 74, 76, as shown in FIG. 7A. However, when the fingers 68 are not supported by the envelope 100 (see FIG. 4B) and positioned below the surface 150, the blade 70 is retreated outward from the gap 78 and away from the blocking position, as shown in FIG. 7B. It is understood that the photosensors 74, 76 include a photoemitter and a photo transistor or diode which is capable to produce a signal indicating the reception of light from the photoemitter. Photosensors are well-known in the art.

It should be noted that the adjustment of the envelope stopper 40 can be carried out manually by an operator who places the envelope 100 at the desirable position and, preferably, moves the envelope sensing assembly from the upstream end 112 towards the downstream end 114. The operator sets the envelope stopper 40 in place upon seeing a signal produced by the photosensors 74, 76, indicating that the fingers 68 just pass the bottom edge 68 of the envelope 100. Alternately, the adjustment of the envelope stopper 40 can be carried out by a moving device which is stopped in response to the signal produced by the photosensors 74, 76.

It should be noted that the blade 70 can be positioned differently so that the photosensors 74, 76 are blocked when the fingers are not supported by the envelope 100 and the photosensors 74, 76 are not blocked when the fingers are supported by the envelope 100.

Furthermore, while it is preferred to place an envelope at the desired location in the inserting area in order to adjust the position of the envelope stopper, it is possible to use an object having a length representative the size of the envelope to replace the envelope. Thus, the reference numeral 100, as shown in FIGS. 3A to 4B, can be used to denote the replacement object for adjustment purposes.

Thus, although the invention has been described with respect to a preferred embodiment thereof, it will be understood by those skilled in the art that the foregoing and various other changes, omissions and deviations in the form and detail thereof may be made without departing from the spirit and scope of this invention.

What is claimed is:

1. An apparatus for adjusting a position of a movable envelope stopper in an inserting area of an envelope insertion machine, wherein the inserting area has an upstream end and an downstream end, and the envelope stopper is positioned between the upstream end and the downstream end for stopping an envelope fed from the upstream end towards the downstream end along a feeding direction in order to place the envelope at a desired location for mail insertion, and wherein the envelope has a size and an edge, and the position of the envelope stopper is adjusted according to the size of the envelope so that the edge of the envelope is substantially aligned with the envelope stopper when the envelope is stopped, said apparatus comprising:

a movable sensing device, coupled in a fixed relative position to the movable envelope stopper, adapted to sense the edge of the envelope when the envelope is placed at the desired location; and at least one or more servo motors for moving the sensing device and the envelope stopper along the feeding direction and for placing the envelope stopper when the sensing device senses the edge of the envelope.

2. The apparatus of claim 1, wherein the envelope stopper has a stop edge which is capable of operating at a first position and a second position, and wherein the envelope stopper is capable of stopping the envelope fed from the upstream end with the stop edge when the stop edge is operated at the first position; and the envelope stopper allows the envelope fed from the upstream to pass by the envelope stopper when the stop edge is operated at the second position, and wherein the stop edge is operated at the second position when the envelope stopper is moved by the moving means along the feeding direction in order to adjust the position of the envelope stopper.

3. The apparatus of claim 1, wherein the sensing device comprises a photosensing device which is adapted to produce a signal when the sensing device senses the edge of the envelope so as to allow the moving means to place the envelope stopper in response to the signal.

4. The apparatus of claim 3, wherein the sensing device further comprises at least one mechanical finger pivotally mount on the sensing device, wherein the mechanical finger is positioned at a first level, supported by the envelope, when the envelope stopper is away from the edge of the envelope and further away from the downstream end, and wherein the mechanical finger is positioned at a second level when the envelope stopper is away from the edge of the envelope and further away from the upstream end, and wherein the photosensor device produces the signal when the position of the mechanical finger is changed from the first level to the second level.

5. The apparatus of claim 4, wherein the photosensing device comprises a pair of photosensors and the finger is coupled to a blocking mechanism such that the photosensors are blocked by the blocking mechanism at a blocking position when the finger is positioned at the first level, and the blocking mechanism is removed from the blocking position when the finger is positioned at the second level.

6. The apparatus of claim 5, wherein the photosensors are separately mounted on a mounting device having a gap separating the photosensors, and wherein the blocking mechanism includes a blade capable of moving into the gap to the blocking position to block the photosensors when the finger is positioned at the first level.

7. The apparatus of claim 5, wherein the relative position between the blocking mechanism and the photosensors is adjustable.

8. The apparatus of claim 4, wherein the envelope is supported by a plurality of supporting means in the inserting area, and the supporting means define a recess there between, and wherein the finger moves into the recess to be positioned at the second level.

9. The apparatus of claim 3, wherein the sensing device further comprises at least one mechanical finger pivotally mount on the sensing device, wherein the mechanical finger is positioned at a first level, supported by the envelope, when the envelope stopper is away from the edge of the envelope and further away from the downstream end, and wherein the mechanical finger is positioned at a second level when the envelope stopper is away from the edge of the envelope and further away from the upstream end, and wherein the photosensor device produces the signal when the position of the mechanical finger is changed from the second level to the first level.

10. A method for adjusting a position of an envelope stopper in an inserting area of an envelope insertion machine, wherein the inserting area has an upstream end and an downstream end, and the envelope stopper is positioned between the upstream end and the downstream end for stopping an envelope fed from the upstream end towards the downstream end along a feeding direction in order to place the envelope for mail insertion, and wherein the envelope has a size, and the position of the envelope stopper is adjusted according to the size of the envelope, said method comprising the steps of:

placing an object at a desired location, wherein the object has an edge and a length representative of the size of the envelope;

providing a sensing device capable of sensing the edge of the object; at least one or more servo motors moving the sensing device and the envelope stopper along the feeding direction; and interrupting the movement of the envelope stopper when the sensing device senses the edge of the object, wherein the sensing device is coupled to the envelope stopper so that the edge of the object is aligned with the envelope stopper when the sensing device senses the edge of the object.

11. The method of claim 10, wherein the sensing device is capable of providing a signal when the sensing device senses the edge of the object and the movement of the envelope stopper is interrupted in response to the signal.

12. The method of claim 11, wherein the sensing device further comprises at least one mechanical finger pivotally mount on the sensing device, wherein the mechanical finger is positioned at a first level, supported by the object, when the envelope stopper is away from the edge of the object and further away from the downstream end, and wherein the mechanical finger is positioned at a second level when the envelope stopper is away from the edge of the object and further away from the upstream end, and wherein the signal is produced when the position of the mechanical finger is changed from the first level to the second level.

13. The method of claim 11, wherein the sensing device further comprises at least one mechanical finger pivotally mount on the sensing device, wherein the mechanical finger is positioned at a first level, supported by the object, when the envelope stopper is away from the edge of the object and further away from the downstream end, and wherein the mechanical finger is positioned at a second level when the envelope stopper is away from the edge of the object and further away from the upstream end, and wherein the signal is produced when the position of the mechanical finger is changed from the second level to the first level.

14. The method of claim 12, wherein the sensing devices further comprises a photosensing device, and the mechanical finger is coupled to a blocking mechanism, and wherein the blocking mechanism is capable of blocking the photosensing device at a blocking position when the finger is positioned at the first level, and the block mechanism is removed from the blocking position when the finger is positioned at the second level, and wherein the photosensing device produces the signal when the blocking devices is removed from the blocking position.

15. The method of claim 12, wherein the sensing devices further comprises a photosensing device, and the mechanical finger is coupled to a blocking mechanism, and wherein the blocking mechanism is capable of blocking the photosensing device at a blocking position when the finger is positioned at the second level, and the block mechanism is removed from the blocking position when the finger is positioned at the first level, and wherein the photosensing device produces the signal when the blocking devices is moved to the blocking position.

16. The method of claim 10, wherein the step of moving the sensing device and the envelope stopper is by an operator.

17. The method of claim 11, wherein the step of moving the sensing device and the envelope stopper is interrupted automatically by the signal.

18. The method of claim 10, wherein the object is an envelope.

* * * * *